United States Patent [19]

Jendrzejek et al.

[11] Patent Number: 4,932,310

[45] Date of Patent: Jun. 12, 1990

[54] BEARING LUBRICATION IN AXIAL PISTON FLUID DEVICES

[75] Inventors: Gary S. Jendrzejek, Milwaukee; Michael J. Voigt, Mequon, both of Wis.

[73] Assignee: The Oilgear Company, Milwaukee, Wis.

[21] Appl. No.: 359,612

[22] Filed: Jun. 1, 1989

[51] Int. Cl.[5] ..... F01B 13/04

[52] U.S. Cl. ..... 91/506; 91/499

[58] Field of Search ..... 91/499, 506

[56] References Cited

U.S. PATENT DOCUMENTS 4,167,895 9/1979 Rubinstein ..... 91/506

*Primary Examiner*—Gerald A. Michalsky

*Attorney, Agent, or Firm*—Quarles & Brady

[57] ABSTRACT

The invention involves improvements to an axial piston fluid device of the type having a housing with a central cavity and a valve plate end, a shaft journaled adjacent its inner end in a bushing mounted in a bore in the valve plate end, and a cylinder barrel surrounding the shaft and rotatable therewith in the cavity and against the valve plate end. The invention utilizes a bushing which has a slot intermediate its ends and the valve plate bore has axial extending recesses leading to and away from the bushing slot. The cylinder barrel and valve end have a series of fluid passageways leading from the cavity to the bore and from the recesses to the space between the cylinder barrel and shaft and then back to the cavity.

5 Claims, 3 Drawing Sheets

BEARING LUBRICATION IN AXIAL PISTON FLUID DEVICES

BACKGROUND OF THE INVENTION

This invention relates to axial piston fluid devices, and more particularly to means for lubricating bearings in such fluid devices.

Axial piston pumps and motors routinely include a rotating cylinder barrel connected to a shaft and containing a plurality of pistons whose ends work against an inclined surface to draw fluid into the cylinders as the pistons are extended and to force fluid out of the same cylinders as the pistons are retracted. The cylinder barrels are commonly journaled in the inner diameter of a large barrel bearing which is mounted in the cavity of the pump or motor housing. Presently, such barrel bearings are typically sleeve bearings with an anti-friction coating on their inner diameter. The shaft which mounts the cylinder barrel is typically supported in a ball bearing at one end of the housing and in a sleeve bearing or bushing at the other end of the housing.

Leakage from the rotating group will result in fluid accumulating in the cavity of the housing. This fluid is typically used to lubricate the moving parts, including the bearings such as the barrel bearing. However, unless there is a pressure differential across the width of the bearings or bushings, there is no assurance that the engaging rotating surfaces will in fact be lubricated.

In our invention we provide a positive means for lubricating the shaft bushing and means for assuring lubrication of the mating surfaces of the barrel bearing and the cylinder barrel even if there is no pressure differential axially across the width of the barrel bearing.

SUMMARY OF THE INVENTION

The invention involves improvements to an axial piston fluid device of the type havng a housing with a central cavity and a valve plate end, a shaft journaled adjacent its inner end in a bushing mounted in a bore in the valve plate end, and a cylinder barrel surrounding the shaft and rotatable therewith in the cavity and against the valve plate end. Our invention utilizes a bushing which is a slot intermediate its ends and the valve plate bore has axial extending recesses leading to and away from the bushing slot. The cylinder barrel and valve plate end have a series of fluid passageways leading from the cavity to the bore and from the recesses to the space between the cylinder barrel and shaft and then back to the cavity.

In the preferred embodiment, one of the passageways is a radial passage from the space between the cylinder barrel and shaft to the cavity. The rotation of the cylinder barrel will cause fluid to be pumped by centrifugal force from that space outwardly to the cavity through the passage in the cylinder barrel. The slight pressure head thereby created, by a pressure head due to the depth of fluid in the cavity or a pressure drop in the cavity drain line, is employed to feed fluid through passages in the valve plate end which lead to a reservoir surrounding the inner end of the shaft. The reservoir is connected to the bore and to the recesses in the bore. The rotation of the cylinder barrel creates a centrifugal pumping which tends to evacuate the space between the shaft and cylinder barrel, thus generating a low pressure region in such space. The fluid from the cavity at a higher pressure then tends to flow through the shaft bushing into this low pressure region. In this manner fluid is circulated under pressure to the inner diameter of the bushing to lubricate the contacting surfaces of the bushing and shaft.

Also in accordance with the invention, in an axial piston fluid device of the type which has the cylinder barrel journaled inside a barrel bearing mounted in the housing, the cylinder barrel is formed with a projecting sleeve received in the barrel bearing and the sleeve is provided with an annular groove along its inner diameter to collect fluid. There are a plurality of radial fluid passageways in the sleeve that lead from the groove to the outer diameter of the sleeve to lubricate the engaging surfaces of the sleeve and of the barrel bearing.

It is a principal object of this invention to provide improved lubrication of sleeve-type bearings in axial piston pumps and motors.

It is also an object of this invention to provide a mechanism for lubricating the shaft bushing of an axial piston fluid device by utilizing the centrifugal force generated by the rotating group to evacuate the space between the cylinder barrel and shaft creating a low pressure region into which cavity drain fluid will tend to flow. The cavity drain fluid is then channeled to flow through the shaft bushing.

It is another object of the invention to provide a mechanism for lubricating the barrel bearing of an axial piston pump even without a pressure differential across the axial width of the bearing.

The foregoing and other objects and advantages of the invention will appear in the following detailed description. In the description reference is made to the drawings which illustrate a preferred embodiment of the invention.

DETAILED DESCRIPTION OF THE PREFERRED EMBODIMENT

Figure 1:
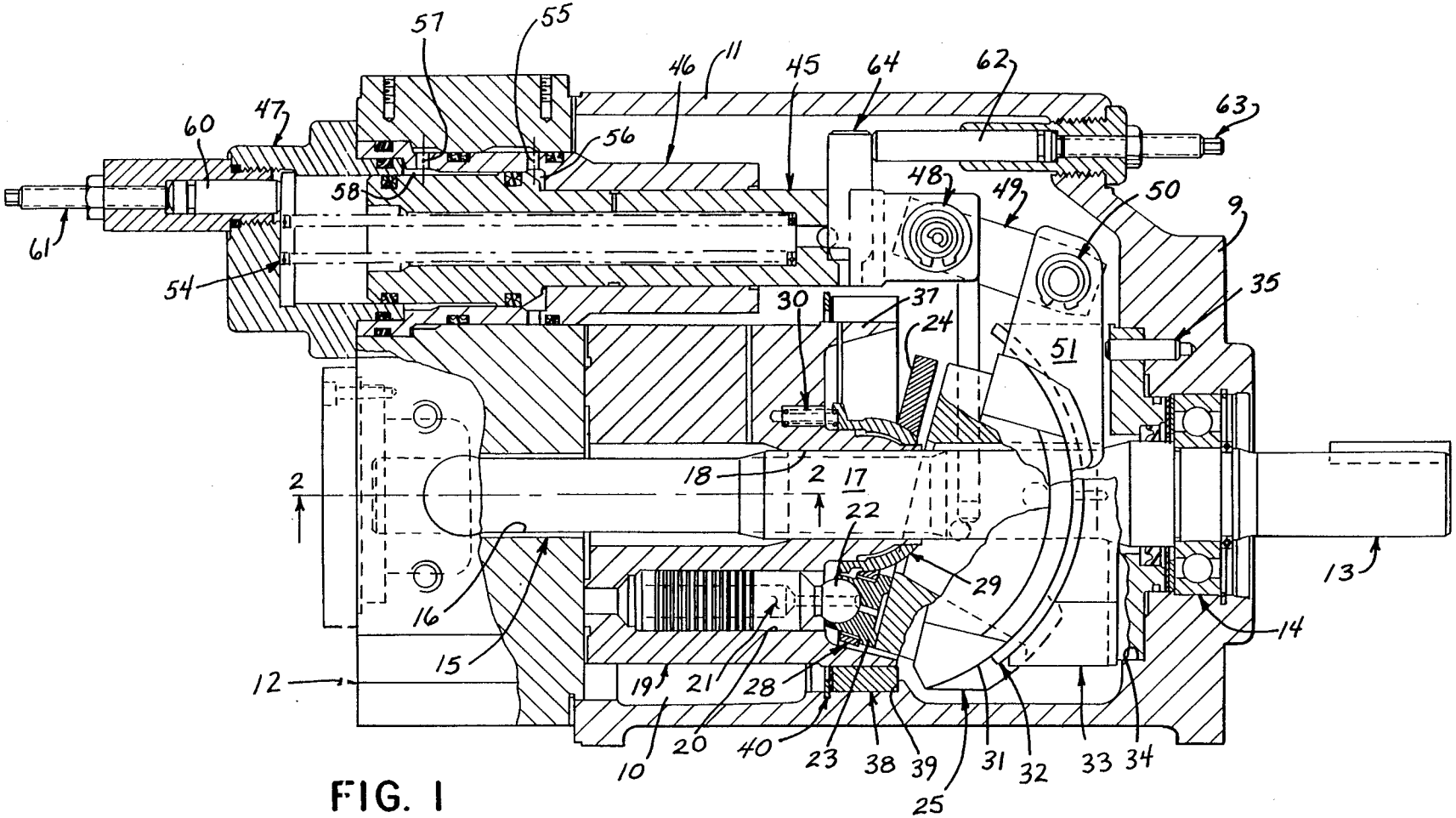
FIG. 1 is a view in vertical cross-section through a variable displacement axial piston pump incorporating the present invention.

Referring to FIG. 1, the invention is shown incorporated in a variable displacement axial piston pump. The pump has a cast housing 9 with a hollow interior to define a cavity 10. The housing 9 includes a crowned portion 11 which accommodates a control piston which will be described more fully hereafter. The open end of the housing 9 is closed by a valve plate 12 which is bolted to the housing. A draft shaft 13 is mounted in a roller bearing 14 supported in the housing at the shaft end of the pump. The inner end of the shaft 13 is journaled in a sleeve bearing or bushing 15 mounted in a bore 16 in the valve plate 12. The drive shaft 13 has splines 17 which engage with mating splines 18 on the interior of a cylinder barrel 19. The cylinder barrel 19 has a plurality of cylinder bores 20 each of which mounts a piston 21 whose end is formed as a ball 22. Piston shoes 23 are pressed about the balls 22 and operate against a flat face 24 of a movable swashblock 25. The series of piston shoes 23 are mounted in a shoe retainer plate 28 which has a spherical central opening that mates with a spherical fulcrum 29. The spherical fulcrum 29 is urged axially towards the swashblock 25 by a plurality of springs 30 mounted in the shaft end of the cylinder barrel 19. The effect of the springs 30 is to urge the spherical fulcrum 29 and the shoe retainer plate 28 axially towards the swashblock 25 to maintain the shoes 23 against the flat face 24 of the swashblock 25. The springs 30 also urge the valve face end of the cylinder barrel 19 against the valve plate 12 to operatively connect the bottoms of the cylinder bores 20 with inlet and outlet ports in the valve plate 12.

The rear of the swashblock 25 has circular cylindrical bearing surfaces 31 that are seated in bearing liners 32 that are, in turn, held against curved bearing surfaces of a saddle 33. The opposite side of the saddle 33 is mounted in a counterbore 34 in an end wall of the housing 9 and the saddle 33 is restrained against radial or rotary movement by a pin 35.

The cylinder barrel 19 has a projecting sleeve portion 37 that is journaled in a cylinder barrel bearing 38 which is mounted in the housing 9 and located between a shoulder 39 and a snap ring 40. The barrel bearing 38 is of known construction with a steel ring having its inner diameter coated with a low friction material such as polytetrafluoride.

The position of the swashblock 25 in the saddle 33 can be varied to adjust the inclination of the face 24 of the swashblock from a position where it is perpendicular to the axis of the shaft 13 to a position where it is inclined to the shaft axis. In a known manner, the degree of inclination will determine the length of the strokes of the piston 21 as the cylinder barrel 19 is rotated by the shaft 13 and to thereby vary the volume of fluid pumped.

The control for varying the position of the swashblock is mounted within the housing 9 in the crown 11. Specifically, a control piston 45 is disposed in a sleeve 46 which in turn is sealed to a piston cap 47. One end of the control piston 45 is connected by a pin 48 to a link 49 which in turn is connected by a pin 50 to an arm 51 projecting from one side of the swashblock 25. A bias spring 54 is seated in the hollow interior of the control piston 45 and bears against an end wall of the piston cap 47. The spring 54 normally urges the control piston 45 to the right as viewed in FIG. 1 so that the swashblock 25 assumes a position of maximum stroke as illustrated in FIG. 1.

The control piston 45 can be moved to the left as viewed in FIG. 1 to move the swashblock 25 towards a neutral position by introducing hydraulic fluid through an inlet 55 into a control pressure volume 56 where an enlarged diameter of the control piston 45 and an enlarged diameter in the sleeve 46 cooperate to cause the control piston 45 to move against the urgings of the spring 54. In returning the piston 45 to a position where the swashblock face 24 is inclined, the spring 54 is assisted by the pressure of hydraulic fluid introduced through another inlet 57 into a pressure volume 58 which acts on the piston 45 by reason of a slightly reduced diameter of the piston 45. The space between the end of the piston 45 and the end of the piston cap 47 is connected to drain so that no pressure is built up in that space.

The maximum and minimum stroke of the control piston 45 are set by adjustable stops. For the minimum stroke, a stop pin 60 is manually located by a threaded stem 61 to have its end engage the corresponding end of the piston 45. For maximum stroke, a similar stop pin 62 can be positioned by a threaded stem 63 to have its end engage the side of a dowel pin 64 that extends laterally from the piston 45.

What has been described thus far are elements and features that are common to known variable displacement axial piston pumps. In such known pumps, the leakage of hydraulic fluid being pumped from around the pistons 20 creates a supply of fluid in the cavity 10 that is used to lubricate the rotating and sliding surfaces. However, there are a number of surfaces that may receive inadequate lubrication from the hydraulic fluid that normally leaks into the cavity. Specific problems can occur with respect to sleeve bearings such as the shaft bushing 15 and the barrel bearing 38.

Figure 2:
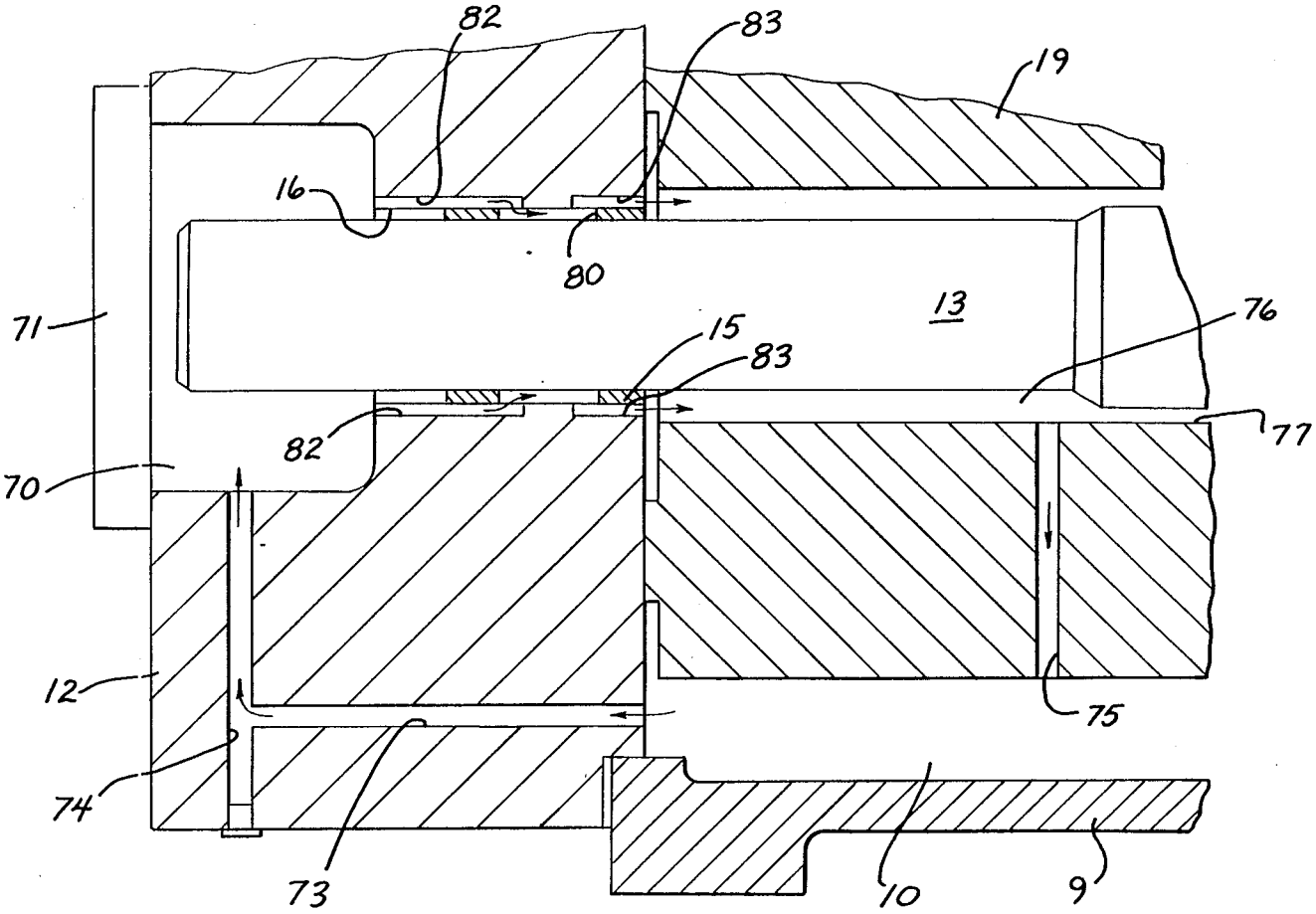
FIG. 2 is an enlarged view in section taken in the plane of the line 2—2 of FIG. 1.
Figure 3:
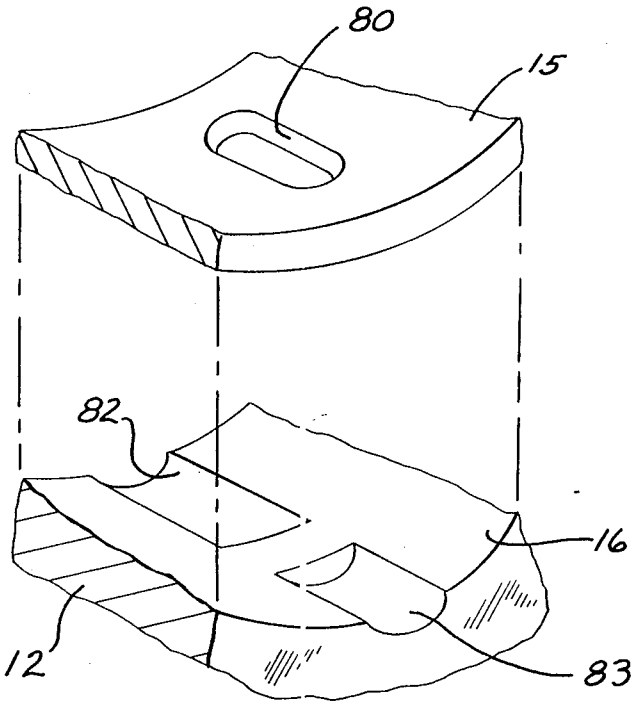
FIG. 3 is a fragmentary exploded view of cooperating portions of the shaft bushing and bore for the shaft bushing.

With respect to lubrication of the shaft bushing 15, our invention utilizes the centrifugal force imparted to fluid within the housing as the rotating group is rotated by the shaft, together with a unique form for the shaft bushing 15 and its bore 16 in the valve plate to insure proper distribution of lubricant over the surfaces of the bushing. Referring to FIGS. 2 and 3, the valve plate 12 has a pocket 70 into which the end of the shaft 13 projects. This pocket is closed by a cover plate 71. The pocket 70 functions as a reservoir for fluid to lubricate the bushing 15. Fluid is supplied to the reservoir 70 under a slight pressure head from the cavity 10 surrounding the cylinder barrel 19. As shown in FIG. 2, the cavity 10 is connected to the reservoir 70 by means of an axial passageway 73 and a radial passageway 74 both formed in the valve plate 12. The cavity 10 is in turn connected by a radial passageway 75 in the cylinder barrel 19 to the space 76 between the inner diameter 77 of the cylinder barrel 19 and the outer diameter of the shaft 13.

The bushing 15 is provided with a pair of elongated diametrically opposite slots 80 which extends along the axis of the bushing. The surface of the bushing bore 16 in the valve plate 12 is provided with diametrically opposed, axially extending recesses 82 and 83 which lead respectively from the reservoir 70 to the bushing slot 80 and from the bushing slot 80 to the space 76 between the cylinder barrel 19 and the shaft 13.

When the cylinder barrel 19 is being rotated by the shaft 13, centrifugal force will cause hydraulic fluid within the space 76 between the shaft and cylinder barrel to be pumped out the radial passageway 75 in the cylinder barrel and into the cavity 10 thus creating a low pressure region in the space 76. The cavity 10 will be at a slight pressure head, such as 1 to 2 psi with respect to the space 76. The slight pressure head will cause fluid to be moved through the passageways 73 and 74 in the valve plate 12 to the reservoir 70. Fluid in the reservoir 70 will be drawn into the space 76 between the cylinder barrel 19 and shaft 13 due to the slight pressure differential between the reservoir 70 and space 76. As that fluid is drawn from the reservoir 70 into the space 76, it will pass through the recesses 82, the bushing slots 80 and the recesses 83. This will provide a source of lubrication for the inside diameter of the bushing 15 as the shaft 13 rotates within the bushing. Fluid is provided not only to one end of the bushing but also to an area adjacent its longitudinal center so that a film of lubricant will be developed within the entire inner diameter of the bushing 15. The fluid will continue to be circulated as shown by the arrows in FIG. 2 while the pump is in operation.

Two slots 80 are required to accommodate both clockwise and counterclockwise shaft rotation, or for two direction operation. The reason is because the shaft 13 is deflected during operation by stroking forces so that there will be clearance between one side of the shaft and the bushing, and a slot 80 should always be located opposite the clearance.

Figure 4:
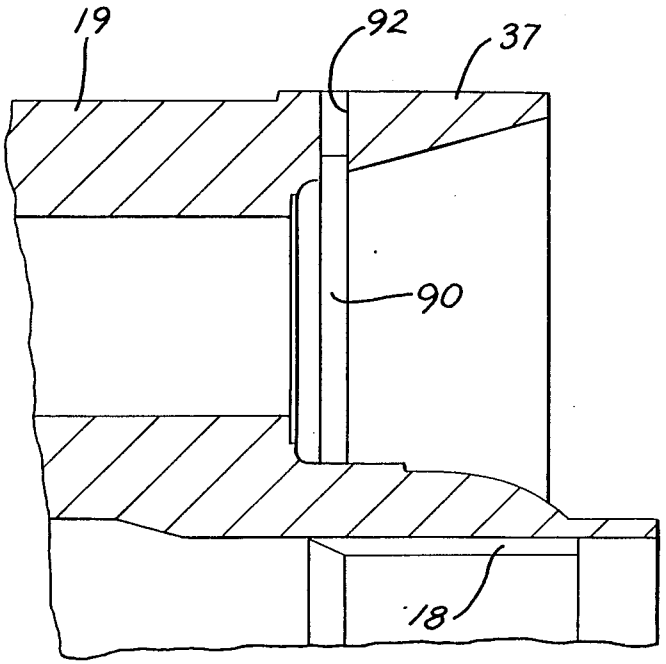
FIG. 4 is an enlarged fragmentary view of the sleeve portion of the cylinder barrel.

Because of the existence of the crown 11 in the housing 10 to mount the control for the swashblock 25, there is no pressure differential between the valve plate side and the shaft end side of the barrel bearing 38. As a result, there is nothing to force fluid axially between the surface of the barrel bearing 38 and the mating surface of the cylinder sleeve portion 37. To provide lubricant to those mating surfaces, an annular groove 90 is formed on the interior of the sleeve portion 37 of the cylinder barrel (see FIG. 4). The annular groove 90 accumulates fluid that leaks past the pistons 21. Fluid collected in the groove 90 will be moved radially by centrifugal force through a plurality of radial passageways 92 which lead through the sleeve portion 37 and to the outside diameter of the sleeve portion 37 and the mating interior diameter of the barrel bearing 38. The interior diameter of the barrel bearing 38 is provided with axial reliefs, in a known manner. By this arrangement, fluid is continuously supplied to the mating surfaces of the barrel bearing and cylinder barrel and including being supplied to the axial reliefs.

Although the invention has been described in relation to a variable displacement pump, it could as well be used with a variable displacement motor or with a fixed pump or motor.

I claim:

1. In an axial piston fluid device including a housing having a central cavity and a valve plate end, a shaft journaled adjacent its inner end in a bushing mounted in a bore in the valve plate end, and a cylinder barrel surrounding the shaft and connected thereto for rotation with the shaft in said cavity and against said valve plate end, the improvement wherein:

the bushing has a slot intermediate its ends;

the bore has axially extending recesses leading to and away from the bushing slot; and the cylinder barrel and valve plate have a series of fluid passageways leading from the cavity to the bore, from the recesses to the space between the cylinder barrel and shaft, and then back to the cavity.

2. A fluid device in accordance with claim 1 wherein the cylinder barrel has a sleeve at its end opposite the valve plate end, said sleeve being journaled at its outer diameter in a barrel bearing mounted in the housing, said sleeve having an annular groove along its inner diameter that is adapted to collect fluid and a plurality of spaced radial fluid passageways that lead from the groove to the outer diameter of the sleeve.

3. In an axial piston fluid device including a housing having a central cavity and a valve plate end, a shaft journaled adjacent its inner end in a bushing mounted in a bore in the valve plate end, and a cylinder barrel surrounding the shaft and connected thereto for rotation with the shaft in said cavity and against said valve plate end, means for lubricating the bushing comprising:

a fluid reservoir in the valve plate end at the inner end of the shaft;

said bushing having an axially extending slot intermediate its ends;

said bore having a first axially extending recess leading from the reservoir to the bushing slot and a second axially extending recess leading from the bushing slot to the space between the cylinder barrel and shaft;

said cylinder barrel having a radial fluid passageway through which fluid can be drawn from said space into the cavity by the rotation of said cylinder barrel; and said valve plate end having a fluid passageway leading from the cavity to the reservoir, whereby the rotation of the cylinder barrel will draw fluid from the reservoir through the recesses and slot and into said space, and will pump fluid from said space into the cavity and back to the reservoir.

4. A fluid device in accordance with claim 3 wherein there are two diametrically opposed slots in said bushing and two diametrically opposed sets of first and second recesses each associated with one slot.

5. In an axial piston fluid device having a housing, a barrel bearing mounted in the housing and a cylinder barrel journaled in the barrel bearing, the improvement wherein:

the cylinder barrel includes a projecting sleeve whose outer diameter is received in the barrel bearing, the sleeve is provided with an annular groove along its inner diameter to collect fluid, and a plurality of radial fluid passageways in the sleeve lead from the groove to the outer diameter of the sleeve to lubricate the engaging surfaces of the sleeve and barrel bearing.

* * * * *